US006999039B2

(12) United States Patent
Chen

(10) Patent No.: US 6,999,039 B2
(45) Date of Patent: Feb. 14, 2006

(54) EXTRUDED SLOT ANTENNA ARRAY AND METHOD OF MANUFACTURE

(75) Inventor: Ming Hui Chen, Rancho Palos Verdes, CA (US)

(73) Assignee: Victory Microwave Corporation, Hsi Chih (TW)

( * ) Notice: Subject to any disclaimer, the term of this patent is extended or adjusted under 35 U.S.C. 154(b) by 0 days.

(21) Appl. No.: 10/943,533

(22) Filed: Sep. 18, 2004

(65) Prior Publication Data

US 2006/0001586 A1 Jan. 5, 2006

Related U.S. Application Data

(60) Provisional application No. 60/521,796, filed on Jul. 4, 2004.

(51) Int. Cl.
*H01Q 13/10* (2006.01)

(52) U.S. Cl. ..... 343/771

(58) Field of Classification Search ..... 343/771, 343/770, 767

See application file for complete search history.

(56) References Cited

U.S. PATENT DOCUMENTS 3,363,253 A * 1/1968 Ratkevich et al. ..... 343/771
4,038,742 A * 8/1977 Kimball et al. ..... 29/600
6,535,173 B1 * 3/2003 Ou ..... 343/770
2003/0011517 A1 * 1/2003 Kolak et al. ..... 343/700 MS

* cited by examiner

*Primary Examiner*—Shih-Chao Chen
*Assistant Examiner*—Angela M Lie
(74) *Attorney, Agent, or Firm*—Clifford B. Perry

(57) ABSTRACT

A method for manufacturing an extruded slot antenna array includes extruding a slot antenna body, the slot antenna including a first major surface, a second major surface, first and second external side walls, and one or more longitudinally extending internal waveguide walls disposed between the first and second major surfaces. Each of the internal waveguide walls forms a respective two or more open-ended waveguides, each open-ended waveguide having a first open end and a second open end. An array of slots is cut on the first major surface of the slot antenna body, the array of slots being arranged in a plurality of rows, one row of slots being formed along a longitudinal line of a respective open-ended waveguide. Next, a row of slots are subsequently cut on the second major surface of the extruded slot antenna body, the row of slots formed substantially perpendicularly to the longitudinal axis of the open-ended waveguides, one of the slots being formed on each of the open-ended waveguides. Next, end caps are attached to the first and second open-ends of each of the open-ended waveguides.

13 Claims, 5 Drawing Sheets

EXTRUDED SLOT ANTENNA ARRAY AND METHOD OF MANUFACTURE

CROSS-REFERENCE TO RELATED APPLICATIONS

This application claims priority to U.S. Provisional application No. 60/521,796, filed Jul. 4, 2004, entitled "Slotted Antenna Array Using Extruded Waveguides," the contents of which are hereby incorporated by reference in its entirety for all purposes.

BACKGROUND

The present invention relates generally to antenna arrays, and more particularly to systems and methods for manufacturing extruded slot array antennas.

FIGS. 1A–1D illustrate four phases used in the conventional manufacturing of a slot antenna array. Initially as shown in FIG. 1A, waveguide trenches 112 are machined into metal stock, thereby forming three sides of the arrays waveguide structures. Subsequently, slots 120 are cut into the bottom of the trench plate 115, slots 120 forming the apertures, which either collect portions of an incident signal, or radiate portions of a transmitted signal. Next, as shown in FIG. 1C, a top plate 130 is aligned and attached to the uncovered surface of the trench plate 115. Top plate 130 has slots 140 disposed thereon, the slots operating to either collect an incident signal from the radiating slots 120 or send the transmitted signal to slots 120. T-structure 160 is positioned over the feed slots 140 of top plate 130, the T-structure 160 having a slot 162 (opposite of side shown). Slot 162 serves as the interface with a waveguide feed network consisting of components 170 and 180, these components forming a feed network that is oriented generally perpendicular to the T-structure 160. Slot 182 disposed on feed network component 180 serves as the input/output port of the slot array antenna.

The conventional slot array antenna produced using the aforementioned conventional manufacturing method is of good quality, but relatively expensive. In large slot arrays having many waveguides, the process of machining waveguide trenches 112 into metal stock is time consuming and expensive. Further, the top plate 130 must be carefully aligned and well bonded with the trench plate 115 in order to ensure proper antenna performance. When it is considered that each of these operations is required to manufacture one slot antenna array, the high costs associated with the conventional approach become clear.

What is needed is a slot antenna array which can be more economically manufactured, and which exhibits the same good quality performance as the traditional machined arrays.

SUMMARY

The present invention provides a slot antenna array and method of manufacture which uses an extruded slot antenna body as a core component. The extruded slot antenna body eliminates the conventional processes of drilling metal stock to forming the waveguide trenches. Additionally, the extruded slot antenna body includes both surfaces onto which the slots 120 and 140 are cut, thereby eliminating the conventional step of aligning two separate plates. Slot antenna arrays can be produced more quickly, economically, and with the same antenna performance compared to traditional machine slot antenna arrays.

A method of manufacturing a slot antenna array is presented in which, initially, a slot antenna body is extruded, the slot antenna including a first major surface, a second major surface, first and second external side walls, and one or more longitudinally extending internal waveguide walls disposed between the first and second major surfaces. Each of the internal waveguide walls forms a respective two or more open-ended waveguides, each open-ended waveguide having a first open end and a second open end. An array of slots is cut on the first major surface of the extruded slot antenna body, the array of slots being arranged in a plurality of rows, one row of slots being formed along a longitudinal line of a respective open-ended waveguide. Next, a row of slots are subsequently cut on the second major surface of the extruded slot antenna body, the row of slots formed substantially perpendicularly to the longitudinal axis of the open-ended waveguides, one of the slots being formed on each of the open-ended waveguides. Next, end caps are attached to the first and second open-ends of each of the open-ended waveguides.

These and other features of the present invention will be better understood when read in view of the following drawings and detailed description.

For clarity, previously identified features retain their reference indicia in subsequent drawings.

DETAILED DESCRIPTION OF EXEMPLARY EMBODIMENTS

Figure 1A:
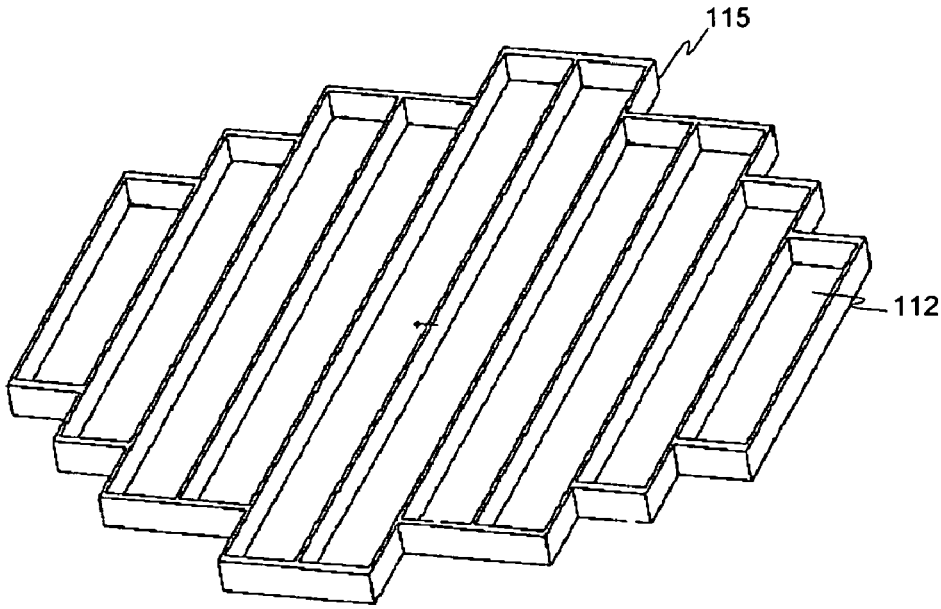
Prior Art Fig. 1A
FIGS. 1A–1D illustrate conventional processes for manufacturing a slot antenna array as known in the art.
Figure 1B:
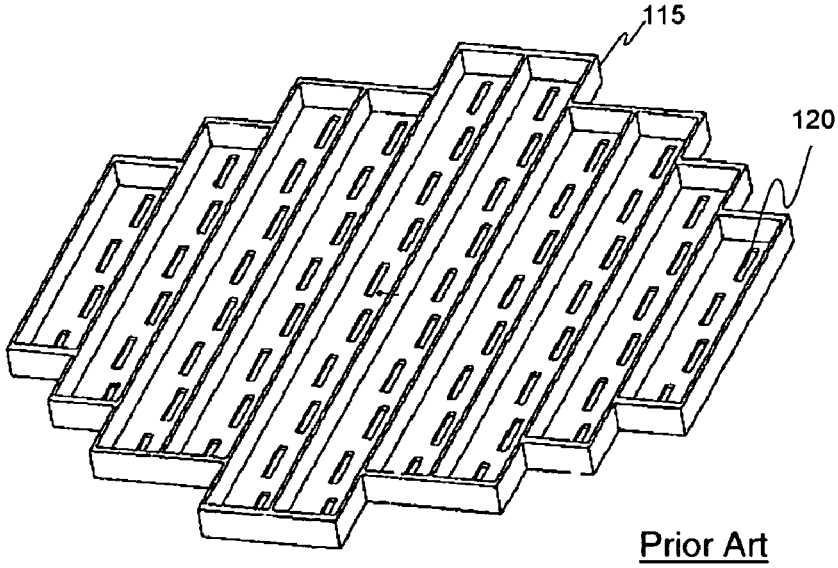
Prior Art Fig. 1B
Figure 1C:
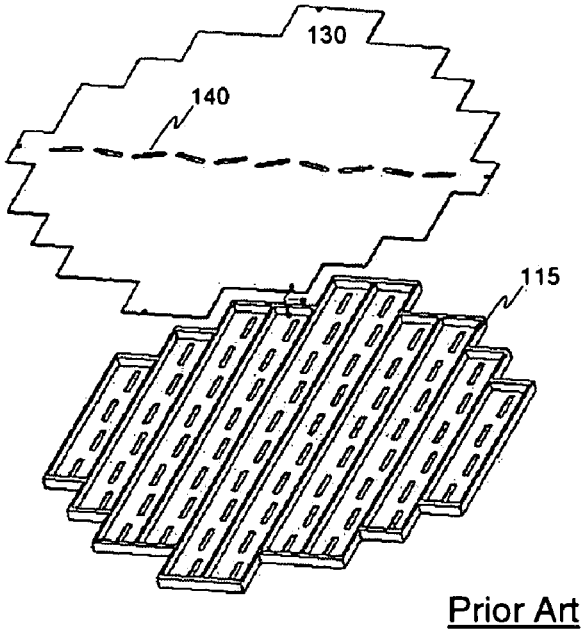
Figure 2:
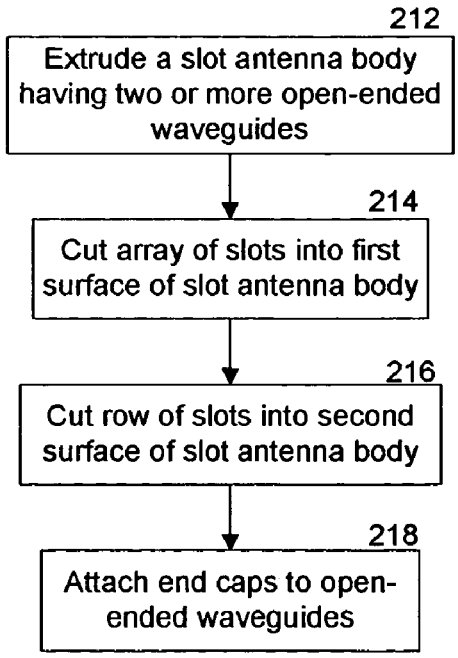
FIG. 2 illustrates a method for manufacturing an extruded slot antenna array in accordance with one embodiment of the present invention.

FIG. 2 illustrates a method for manufacturing an extruded slot antenna array in accordance with one embodiment of the present invention. Initially at 212, a slot antenna body is extruded. As further illustrated below, the extruded slot antenna body includes two major surfaces, to external side walls, and one or more internal waveguide walls which form a corresponding two or more open-ended waveguides. The extruded antenna body may be in the size and shape as needed, or in another embodiment, be trimmed in one or more areas. In a particular embodiment of the invention, the process is carried out using a conventional extruding machine capable of producing a slot antenna body of the needed dimensions. An exemplary embodiment of this process is further described below.

Next at 214, an array of slots is cut into a first of the two major surfaces of the extruded slot antenna body. The array of slots is arranged in rows, one row of slots being formed along a longitudinal line of a respective open-ended waveguide, as shown. In a further specific embodiment, each row of slots is centered along the longitudinal center line of the open-ended waveguide. Subsequently at 216, a row of slots is cut into the second of the two major surfaces of the extruded slot antenna body. The row of slots cut into the second surface are arranged substantially perpendicular to the longitudinal center-line of the open-ended waveguides, and the slots are distributed such that one slot is disposed on the surface of each open-ended waveguide.

Figure 1D:
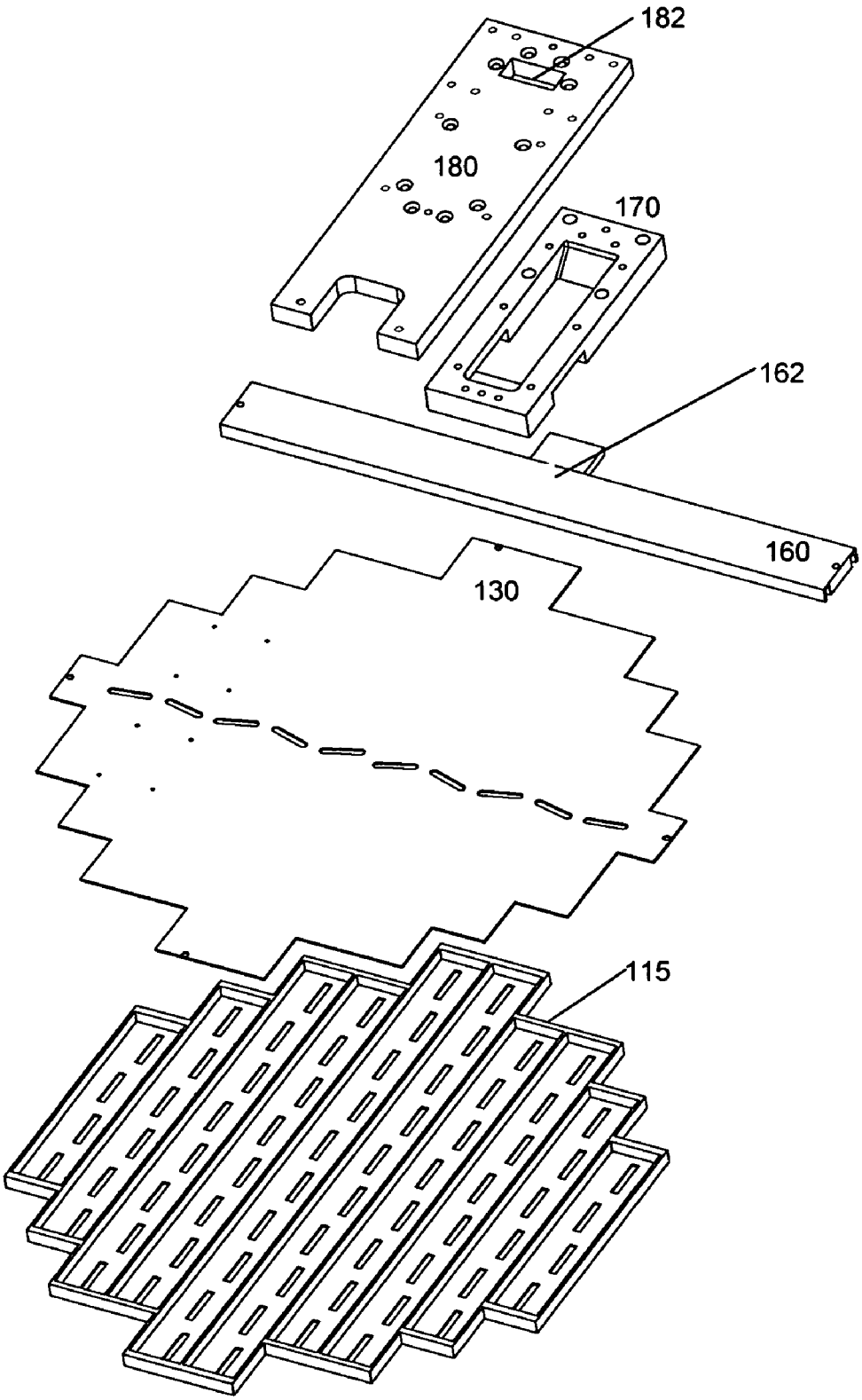
Prior Art Fig. 1D

Next at 218, end caps are attached to the open ends of the waveguides. The attachments may be made by permanent means (e.g., welding) or by removable means (e.g. by screws, etc.). A feed structure, such as that consisting of components 160, 170 and 180 shown in FIG. 1D is attached to antenna body, thereby forming a complete array assembly.

Figure 3:
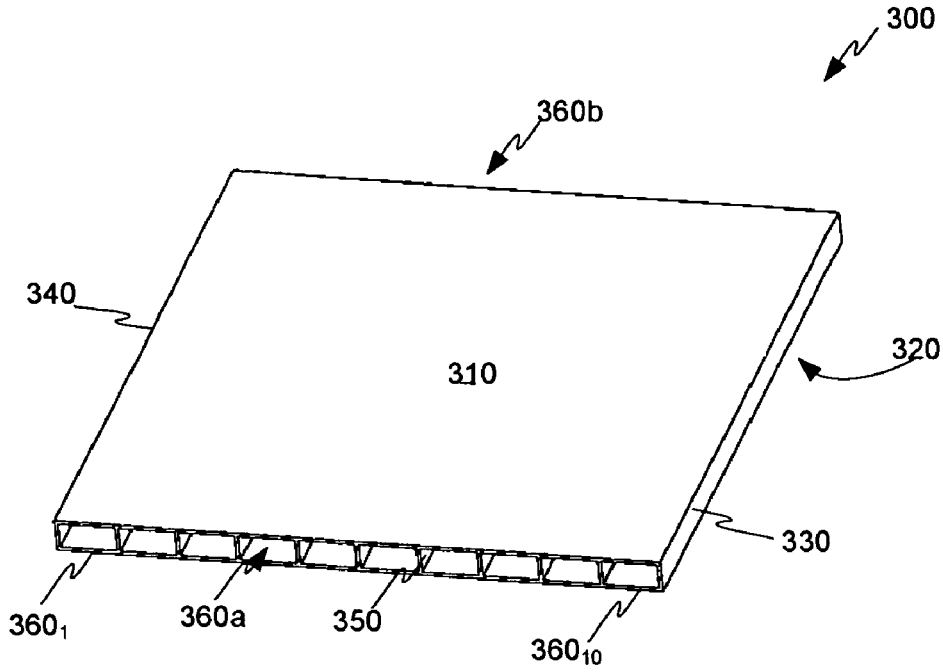
FIG. 3 illustrates an extruded slot antenna body manufactured in accordance with the present invention.

FIG. 3 illustrates an extruded slot antenna body 300 manufactured in accordance with the process 212 of FIG. 2. The extruded slot antenna body 300 includes a first and second major surfaces 310 and 320, first and second side walls 330 and 340, and one or more longitudinally-extending internal waveguide walls 350 (nine shown in the exemplary embodiment), each of the waveguide wall forming a respective two or more open-ended waveguides 360 (ten shown in the exemplary embodiment). Each of the open-ended waveguides 360 have first and second open ends 360*a* and 360*b*.

In a specific embodiment, the extruded slot antenna body 300 is composed of aluminum, although other metals may be used in alternative embodiments. Further specifically, the open-ended waveguides 360 are fabricated to have substantially the same internal height and width dimensions, these dimensions being primarily dictated by the desired frequency of operation as known to those skilled in the art. If desired, the open-ended waveguides 360 may comprise differing height and/or width dimensions.

The process of 214, in one embodiment, includes extruding a slot antenna body of an irregular shape, such that one or more of the open-ended waveguides are of different lengths. Such an arrangement in which one or more waveguides are of different lengths is commonly used in slot antenna arrays, and the extrusion process can be configured such that the each of the open-ended waveguides is formed to its desired length. Alternatively, the process of 214 includes an optional trimming process by which one or more waveguides are trimmed according to their desired lengths. This process is advantageous in that the extrusion process is less complicated that than the foregoing, as all of the waveguides may be initially extruded to the same length. One or more of the waveguides can then be trimmed precisely to the length desired. In a particular embodiment of this process, the slot antenna body 300 is extruded to be the length of the longest waveguide(s), thereby obviating the need to trim those particular waveguides.

Additional processes may be optionally employed to provide further advantages. For example, the first and second major surfaces 310 and 320 may be thinned (e.g. using machining or grinding) to reduce the corresponding top and bottom wall thicknesses, thereby decreasing the total weight of the array. Weight reduction is especially advantageous in avionics applications in which slot array antennas are widely used. Such a thinning operation is typically not possible using the two separate plates in the conventional approach, as the two plates would be easily warped if thinned.

Figure 4:
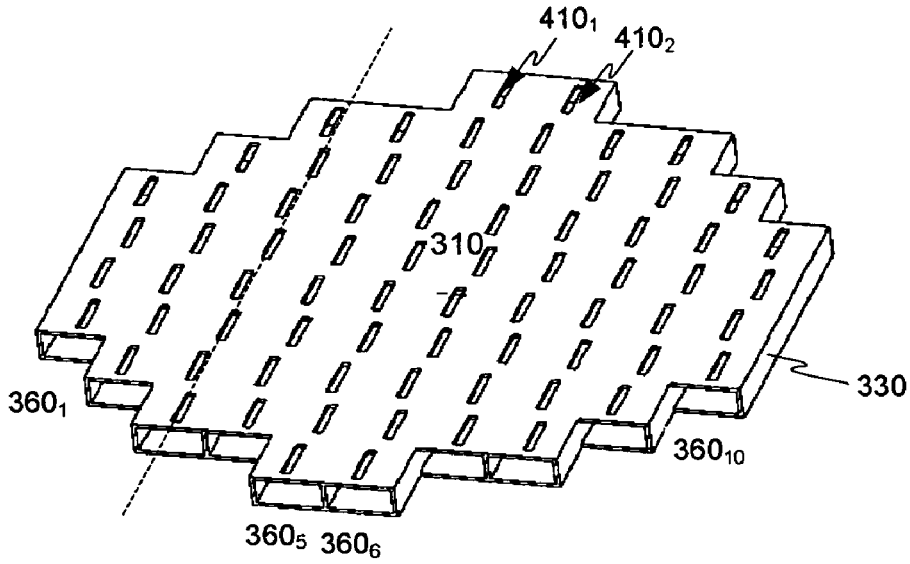
FIG. 4 illustrates the extruded slot antenna body of FIG. 3 having an array of slots cut into the first of the structure's two main surfaces in accordance with the present invention.

FIG. 4 illustrates the slot antenna body 300 of FIG. 3 after trimming and an array of slots have been cut into the first main surface 310 in accordance with one embodiment of process 214. In the particular embodiment shown, the open-ended waveguides 360 are extruded to the desired length or trimmed such that two or more are of the same length, although not necessarily contiguous waveguides 360. For example, two non-contiguous waveguides $\mathbf{360}_1$ and $\mathbf{360}_{10}$ are trimmed to have the same length, as well as waveguides $\mathbf{360}_2$ and $\mathbf{360}_9$. Further it is noted that some of the waveguides 360 may not require trimming if such an operation is employed, for example the two center waveguides $\mathbf{360}_5$ and $\mathbf{360}_6$ do not requiring trimming in the shown embodiment.

Further as shown in FIG. 4, an array of slots 410 are cut into the first surface 310, the array of slots being arranged in rows whereby a row of slots is aligned substantially along a longitudinal line of a respective open-ended waveguide, the slots 410 operable to collect a signal incident on the array 300, and/or for transmitting a signal from the array 300 to a remote location. In a specific embodiment, the row of slots is arranged along the longitudinal center line of a respective waveguide. The number, aperture dimensions and orientation of slots 410 are determined in the conventional manner according to the desired frequency of operation. In a particular embodiment, corresponding slots of similar waveguides, e.g., slots $\mathbf{410}_1$ and $\mathbf{410}_2$ of waveguides $\mathbf{360}_5$ and $\mathbf{360}_6$, are constructed so as to have the same aperture dimensions (i.e., width and length of the slot opening) and orientation (i.e., angle relative to longitudinal center line). In a specific embodiment, slots 410 are aligned and cut onto the first major surface 310 using a numerically-controlled (NC) machine or such similar apparatus.

Figure 5:
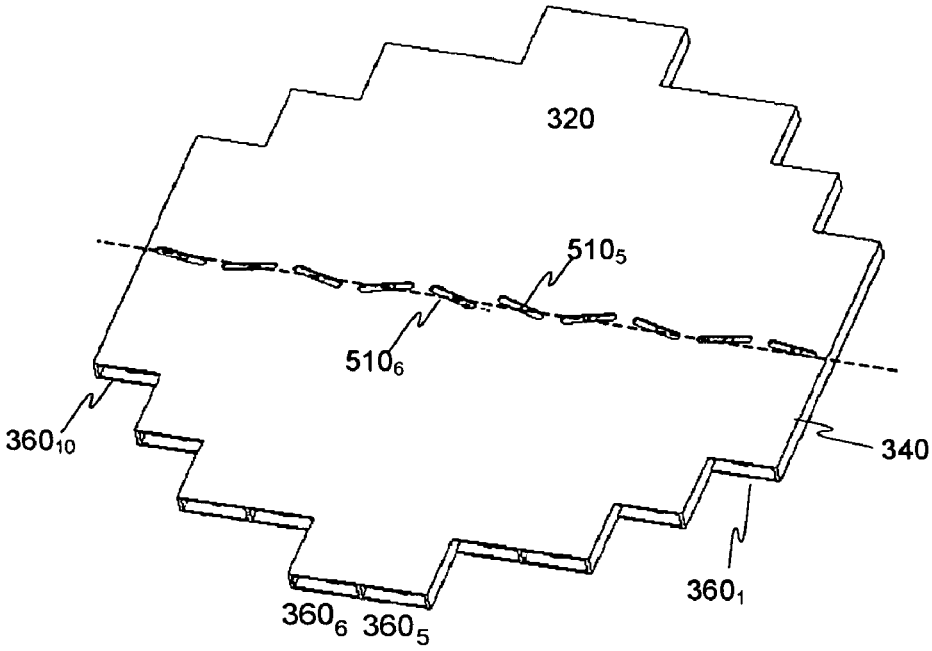
FIG. 5 illustrates the extruded slot antenna body of FIG. 4 having a row of slots cut into the second of the structure's two main surfaces in accordance with the present invention.

FIG. 5 illustrates the slot antenna body 300 of FIG. 4 after a row of slots 510 have been cut into the second main surface 320 in accordance with process 216. As shown, the row of slots are aligned substantially perpendicular to the longitudinal axis of the open-ended waveguides. Additionally, slots 510 are arranged such that one slot is cut onto the surface of each of the open-ended waveguides 360 to permit collecting a signal from the respective waveguide (during signal reception) or to feed a signal into the waveguide (for signal transmission).

Slots 510 may have different orientations (angles relative to the row center line), in order to transmit and/or receive signals at particular polarization orientations in order to generate the desired composite beam pattern. In a particular embodiment, slots of common waveguides, e.g., slots $\mathbf{510}_5$ and $\mathbf{510}_6$ of waveguides $\mathbf{310}_5$ and $\mathbf{310}_6$, are constructed so as to have the same aperture dimensions (i.e., width and length of the slot opening) and orientation (i.e., angle relative to row center line). In a specific embodiment, slots 510 are aligned and cut onto the second major surface 320 using a numerically-controlled (NC) machine or such similar apparatus.

Figure 6:
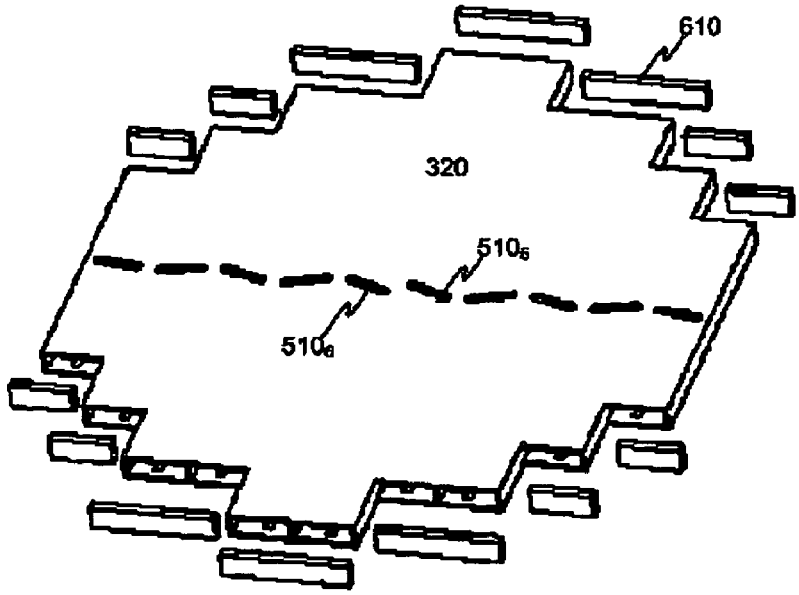
FIG. 6 illustrates the attachment of end slots on the extruded slot antenna body of FIG. 5.

FIG. 6 illustrates the attachment of end caps 610 on the slot antenna body of FIG. 5 in accordance with process 218 (FIG. 2). In a specific embodiment, end caps 610 are attached by a wielding operation, although other techniques, removable (e.g., via screws) or non-removable may be used as well. Further specifically, the end caps 610 are constructed from the same/substantially similar material as the extruded slot antenna body 300. The previously described feed network components are attached to the assembly in the manner as described above, thereby forming a complete slot antenna array.

In exemplary embodiments of the processes and systems described herein, a ten-waveguide slot antenna array is constructed for operation within the 8.2–12.4 GHz frequency band as shown in FIGS. 4–6. Initially, a conventional extruding machine is used to extrude an aluminum antenna body such as shown in FIG. 3, the extruded antenna body 300 measuring 250 mm long (as measured along the longitudinal axis of waveguides 360, generally the z-axis dimension of FIG. 3) by 225 mm wide (as measured across the open-ends of the waveguides 360, generally the x-axis dimension of FIG. 3) by 6.0 mm deep (as measured along the y-axis dimension of the FIG. 3). The extruded antenna body 300 includes nine internal walls 350 which forms ten open-ended waveguides 350, each internal wall 350 being generally 1.0 mm in thickness, and each open-ended waveguide having a cross section of 21 mm (as measured along the x-axis) by 6 mm (as measured along the y-axis), these dimensions representing those generally of conventional WR90 waveguides. Optionally, the first and second major surfaces 310 and 320 are thinned, such that the corresponding wall thicknesses are 0.2–0.3 mm. While an array of 10 waveguides is shown, those skilled in the art will understand that a different number may be employed. For example, a large number of waveguides may be implemented to provide a larger antenna aperture and greater antenna gain.

Subsequently, the extruded slot antenna body 300 is trimmed, such that two or more open-ended waveguide are of substantially the same length. In the exemplary embodiment shown in FIG. 3, open-ended waveguides $\mathbf{310}_1$ and $\mathbf{310}_{10}$ are trimmed to a length of 104 mm, subsequent waveguides $\mathbf{360}_2$ and $\mathbf{360}_9$ are trimmed to 152 mm, waveguides $\mathbf{360}_3$, $\mathbf{360}_4$, $\mathbf{360}_7$ and $\mathbf{360}_8$ are trimmed to a length of 200 mm, and waveguides $\mathbf{360}_5$ and $\mathbf{360}_6$ remaining untrimmed at 250 mm long. Trimming the outer-most waveguides results in a "circular" shaped antenna array, which may be desired in the particular physical foot print sought and/or the antenna beam pattern formed. In an alternative embodiment in which a substantially square or rectangular slot antenna array is desired, the trimming operation may be omitted.

Next, a conventional numerically-controlled machine is used to cut slots 410 into the first main surface 310, the slots having dimensions 3 mm wide by 17 mm long and aligned generally along a longitudinal line of the respective open-ended waveguide. Slots 510 are cut onto the second major surface 320 (also using an NC machine or similar apparatus), the slots aligned substantially along a line perpendicular to the longitudinal line of the open-ended waveguides 360, as shown in FIG. 4. Dimensions of slots 510 are generally 3 mm wide by 17 mm long, and have angular orientations which are offset from the center line as shown, whereby slots formed on corresponding waveguides have matching dimensions and angular orientations. That is, the dimensions and angular orientation slots of $\mathbf{310}_1$ and $\mathbf{310}_{10}$ are substantially identical, and the same relationship applies for waveguides $\mathbf{360}_2$ and $\mathbf{360}_9$, $\mathbf{360}_3$ and $\mathbf{360}_8$, $\mathbf{360}_4$ and $\mathbf{360}_7$, and $\mathbf{360}_5$ and $\mathbf{360}_6$. The angular orientation of slots 510 will vary depending upon the particular design parameters of the array, and in one exemplary embodiment varies between ±17°.

Subsequently, end caps 610 are attached to the first and second open ends of waveguides 360 by means of a welding operation. Feed network components 160, 170 and 180 described above are attached to the antenna body 300 to complete the assembly of the slot antenna array.

As can be appreciated by those skilled in the art, the described processes may be implemented in hardware, software, firmware or a combination of these implementations as appropriate. For example, the processes for cutting slots 410 and 510 on the first and second surfaces may be carried out using a numerically controlled machine. In addition, some or all of the described processes may be implemented as computer readable instruction code resident on a computer readable medium (removable disk, volatile or non-volatile memory, embedded processors, etc.), the instruction code operable to program a computer of other such programmable device to carry out the intended functions.

The foregoing description has been presented for purposes of illustration and description. It is not intended to be exhaustive or to limit the invention to the precise form disclosed, and obviously many modifications and variations are possible in light of the disclosed teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for manufacturing an extruded slot antenna array, comprising:

extruding a slot antenna body comprising a first major surface, a second major surface, first and second external side walls, and one or more longitudinally extending internal waveguide walls disposed between the first and second major surfaces, each internal waveguide wall forming a respective two or more open-ended waveguides, each open-ended waveguide comprising a first open end and a second open end;

cutting an array of slots on the first major surface of the slot antenna body, the array of slots being arranged in a plurality of rows, each row arranged substantially along a longitudinal line of a respective open-ended waveguide;

cutting a row of slots on the second major surface of the extruded slot antenna body, the row of slots aligned substantially perpendicular to the longitudinal axis of the open-ended waveguides, wherein the slots are distributed such that each open-ended waveguide comprises one of the slots; and attaching end caps to the first and second open-ends of each of the open-ended waveguides.

2. The method of claim 1, further comprising trimming the first open-end, the second open-end, or both the first and the second open-ends of one or more of the open-ended waveguides before attaching the end caps thereto.

3. The method of claim 1, wherein the extruded slot antenna body comprises aluminum.

4. The method of claim 1, wherein attaching the end caps comprises a wielding operation.

5. The method of claim 1, wherein each of the plurality of rows of the array of slots is aligned along the longitudinal center line of a respective one open-ended waveguide.

6. An extruded slot antenna array, comprising:

an extruded slot antenna body comprising a first major surface, a second major surface, and one or more longitudinally extending internal waveguide walls disposed between the first and second major surfaces, each internal waveguide wall and forming a respective two or more open-ended waveguides, each open-ended waveguide comprising a first open end and a second open end;

an array of slots on the first major surface of the slot antenna body, the array of slots comprising a plurality of rows, each of the plurality of rows aligned substantially along a longitudinal line of a respective open-ended waveguide; and a row of slots on the second major surface of the extruded slot antenna body, the row of slots aligned substantially perpendicular to the longitudinal axis of the open-ended waveguides, wherein each open-ended waveguide comprises one of the slots formed in the row;

end caps to the first and second open-ends of each of the open-ended waveguides.

7. The extruded slot antenna array of claim 6, wherein the extruded slot antenna body comprises aluminum.

8. The extruded slot antenna array of claim 6, wherein the end caps comprise aluminum.

9. A system for manufacturing an extruded slot antenna array, comprising:

means for extruding a slot antenna body comprising a first major surface, a second major surface, first and second external side walls, and one or more longitudinally extending internal waveguide walls disposed between the first and second major surfaces, each internal waveguide wall forming a respective two or more open-ended waveguides, each open-ended waveguide comprising a first open end and a second open end;

means for cutting an array of slots on the first major surface of the slot antenna body, the array of slots comprising a plurality of rows, each of the plurality of rows aligned substantially along a longitudinal line of a respective open-ended waveguide; and means for cutting a row of slots on the second major surface of the extruded slot antenna body, the row of slots aligned substantially perpendicular to the longitudinal axis of the open-ended waveguides, wherein each open-ended waveguide comprises one of the slots formed in the row; and means for attaching end caps to the first and second open-ends of each of the open-ended waveguides.

10. The system of claim 9, further comprising means for trimming the first open-end, the second open-end, or both the first and the second open-ends of one or more of the open-ended waveguides before attaching the end caps thereto.

11. The system of claim 9, wherein the means for attaching the end caps includes a wielding operation.

12. A computer program product, resident on a computer readable medium, which is operable to execute instruction code for controlling a system to manufacture an extruded slot antenna array, the computer program produce comprising:

code instructing the system to extrude a slot antenna body comprising a first major surface, a second major surface, first and second external side walls, and one or more longitudinally extending internal waveguide walls disposed between the first and second major surfaces, each internal waveguide wall forming a respective two or more open-ended waveguides, each open-ended waveguide comprising a first open end and a second open end;

code instructing the system to cut an array of slots on the first major surface of the slot antenna body, the array of slots being arranged in a plurality of rows, wherein one row of slots is aligned substantially along a longitudinal line of a respective open-ended waveguide;

code instructing the system to cut a row of slots on the second major surface of the extruded slot antenna body, the row of slots aligned substantially perpendicular to the longitudinal axis of the open-ended waveguides, wherein the slots are distributed such that each open-ended waveguide comprises one of the slots; and code instructing the system to attach end caps to the first and second open-ends of each of the open-ended waveguides.

13. The computer program product of claim 12, further comprising code instructing the system to trim the first open-end, the second open-end, or both the first and the second open-ends of one or more of the open-ended waveguides before attaching the end caps thereto.

* * * * *